US007841409B2

(12) United States Patent
Gano et al.

(10) Patent No.: US 7,841,409 B2
(45) Date of Patent: Nov. 30, 2010

(54) SAND CONTROL SCREEN ASSEMBLY AND METHOD FOR USE OF SAME

(75) Inventors: John C. Gano, Carrollton, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 217 days.

(21) Appl. No.: 12/201,776

(22) Filed: Aug. 29, 2008

(65) Prior Publication Data

US 2010/0051271 A1 Mar. 4, 2010

(51) Int. Cl.
*E21B 43/08* (2006.01)
*E03B 3/18* (2006.01)

(52) U.S. Cl. ..... 166/278; 166/236; 277/934

(58) Field of Classification Search ..... 166/278, 166/236, 227; 277/934
See application file for complete search history.

(56) References Cited

U.S. PATENT DOCUMENTS

| | | | | |
|---|---|---|---|---|
| 921,337 | A | 5/1909 | Archer | |
| 1,811,235 | A | 1/1926 | King | |
| 2,837,032 | A * | 6/1958 | Horsting, Sr. | 92/78 |
| 2,942,668 | A * | 6/1960 | Maly et al. | 166/185 |
| 2,945,541 | A | 7/1960 | Maly et al. | |
| 2,981,333 | A * | 4/1961 | Miller et al. | 166/276 |
| 3,099,318 | A * | 7/1963 | Miller et al. | 166/227 |
| 3,390,724 | A | 7/1968 | Caldwell | |
| 4,585,064 | A | 4/1986 | Graham et al. | |
| 4,670,501 | A | 6/1987 | Dymond et al. | |
| 5,107,927 | A * | 4/1992 | Whiteley et al. | 166/50 |
| 5,249,627 | A | 10/1993 | Harms et al. | |
| 5,355,949 | A * | 10/1994 | Sparlin et al. | 166/236 |
| 5,450,898 | A * | 9/1995 | Sparlin et al. | 166/227 |
| 5,816,742 | A * | 10/1998 | Cordewener | 405/43 |
| 5,833,000 | A | 11/1998 | Weaver et al. | |
| 5,836,392 | A | 11/1998 | Urlwin-Smith | |
| 5,839,510 | A | 11/1998 | Weaver et al. | |

(Continued)

FOREIGN PATENT DOCUMENTS

| | | | |
|---|---|---|---|
| EP | 1792049 | A1 | 6/2006 |
| EP | 1759086 | A1 | 6/2007 |
| GB | 2421527 | A | 6/2006 |
| GB | 2462009 | A * | 1/2010 |
| WO | 9626350 | | 8/1996 |

(Continued)

OTHER PUBLICATIONS

Dave Allison; Swellable Rubber Technology Joins Cementing; E&P (May 2007).
Drew Hembling; Aramco Uses Swell Parkers to Enable Smart Open-Hole, Multilateral Completions for EOR; Completions (Sep./Oct. 2007) (pp. 108-114).

(Continued)

*Primary Examiner*—Jennifer H Gay
(74) *Attorney, Agent, or Firm*—Lawrence R. Youst

(57) ABSTRACT

A sand control screen assembly (40) is operably positionable within a wellbore (64). The sand control screen assembly (40) includes a base pipe (42) having at least one opening (46) in a sidewall portion thereof. A filter medium (48) is disposed exteriorly of at least a first circumferential portion of the base pipe (42). The filter medium (48) is in fluid communication with the at least one opening (46). A swellable material layer (56) is disposed exteriorly of a second circumferential portion of the base pipe (42) such that in response to contact with an activating fluid, radial expansion of the swellable material layer (56) causes the filter medium (48) to contact the wellbore (64).

24 Claims, 8 Drawing Sheets

U.S. PATENT DOCUMENTS

| | | | | |
|---|---|---|---|---|
| 5,853,048 | A | 12/1998 | Weaver et al. | |
| 5,874,490 | A | 2/1999 | Arora et al. | |
| 5,934,376 | A | 8/1999 | Nguyen et al. | |
| 6,003,600 | A | 12/1999 | Nguyen et al. | |
| 6,192,986 | B1 | 2/2001 | Ulwin-Smith | |
| 6,196,317 | B1 | 3/2001 | Hardy | |
| 6,263,966 | B1 | 7/2001 | Haut et al. | |
| 6,302,207 | B1 | 10/2001 | Nguyen et al. | |
| 6,311,773 | B1 | 11/2001 | Todd et al. | |
| 6,427,775 | B1 | 8/2002 | Dusterhoft et al. | |
| 6,439,309 | B1 | 8/2002 | Matherly et al. | |
| 6,446,722 | B2 | 9/2002 | Nguyen et al. | |
| 6,457,518 | B1 | 10/2002 | Castano-Mears et al. | |
| 6,481,494 | B1 | 11/2002 | Dusterhoft et al. | |
| 6,540,022 | B2 | 4/2003 | Dusterhoft et al. | |
| 6,543,545 | B1 | 4/2003 | Chatterji et al. | |
| 6,557,635 | B2 | 5/2003 | Nguyen et al. | |
| 6,571,872 | B2 | 6/2003 | Dusterhoft et al. | |
| 6,575,245 | B2 * | 6/2003 | Hurst et al. | 166/278 |
| 6,582,819 | B2 | 6/2003 | McDaniel et al. | |
| 6,588,507 | B2 | 7/2003 | Dusterhoft et al. | |
| 6,653,436 | B2 | 11/2003 | Back et al. | |
| 6,677,426 | B2 | 1/2004 | Noro et al. | |
| 6,698,519 | B2 | 3/2004 | Nguyen et al. | |
| 6,702,019 | B2 | 3/2004 | Dusterhoft et al. | |
| 6,719,051 | B2 | 4/2004 | Hailey, Jr. et al. | |
| 6,755,245 | B2 | 6/2004 | Nguyen et al. | |
| 6,766,862 | B2 | 7/2004 | Chatterji et al. | |
| 6,772,837 | B2 | 8/2004 | Dusterhoft et al. | |
| 6,854,522 | B2 | 2/2005 | Brezinski et al. | |
| 6,886,634 | B2 | 5/2005 | Richards | |
| 6,899,176 | B2 | 5/2005 | Hailey, Jr. et al. | |
| 6,956,086 | B2 | 10/2005 | Back et al. | |
| 7,013,979 | B2 * | 3/2006 | Richard | 166/369 |
| 7,036,587 | B2 | 5/2006 | Munoz, Jr. et al. | |
| 7,096,945 | B2 | 8/2006 | Richards et al. | |
| 7,108,062 | B2 | 9/2006 | Castano-Mears et al. | |
| 7,108,083 | B2 | 9/2006 | Simonds et al. | |
| 7,114,560 | B2 | 10/2006 | Nguyen et al. | |
| 7,131,491 | B2 | 11/2006 | Blauch et al. | |
| 7,153,575 | B2 | 12/2006 | Anderson et al. | |
| 7,191,833 | B2 | 3/2007 | Richards | |
| 7,216,706 | B2 | 5/2007 | Echols et al. | |
| 7,431,098 | B2 | 7/2007 | Ohmer et al. | |
| 7,252,142 | B2 | 8/2007 | Brezinski et al. | |
| 7,258,166 | B2 * | 8/2007 | Russell | 166/229 |
| 7,264,047 | B2 | 9/2007 | Brezinski et al. | |
| 7,267,171 | B2 | 9/2007 | Dusterhoft et al. | |
| 7,299,875 | B2 | 11/2007 | Nguyen | |
| 7,299,882 | B2 | 11/2007 | Brezinski et al. | |
| 7,318,481 | B2 * | 1/2008 | Richard | 166/369 |
| 7,320,367 | B2 | 1/2008 | Brezinski et al. | |
| 7,520,327 | B2 | 1/2008 | Surjaatmadja | |
| 7,350,579 | B2 | 4/2008 | Gatlin et al. | |
| 7,363,986 | B2 | 4/2008 | Brezinski et al. | |
| 7,373,991 | B2 | 5/2008 | Vaidya et al. | |
| 7,387,165 | B2 | 6/2008 | Lopez de Cardenas et al. | |
| 7,392,847 | B2 | 7/2008 | Gatlin | |
| 7,404,437 | B2 | 7/2008 | Brezinski et al. | |
| 7,426,962 | B2 | 9/2008 | Moen et al. | |
| 7,451,815 | B2 | 11/2008 | Hailey | |
| 7,493,947 | B2 * | 2/2009 | Ross | 166/228 |
| 7,511,487 | B2 | 3/2009 | Badry et al. | |
| 7,562,709 | B2 * | 7/2009 | Saebi et al. | 166/278 |
| 7,581,586 | B2 * | 9/2009 | Russell | 166/229 |
| 7,644,773 | B2 * | 1/2010 | Richard | 166/382 |
| 7,703,520 | B2 * | 4/2010 | Dusterhoft | 166/278 |
| 7,712,529 | B2 * | 5/2010 | Dusterhoft et al. | 166/278 |
| 2004/0035590 | A1 * | 2/2004 | Richard | 166/384 |
| 2004/0060695 | A1 | 4/2004 | Castano-Mears et al. | |
| 2004/0134656 | A1 | 7/2004 | Richards | |
| 2005/0077052 | A1 | 4/2005 | Ohmer | |
| 2005/0126776 | A1 * | 6/2005 | Russell | 166/229 |
| 2005/0173130 | A1 * | 8/2005 | Richard | 166/384 |
| 2005/0205263 | A1 * | 9/2005 | Richard | 166/369 |
| 2005/0277554 | A1 | 12/2005 | Blauch et al. | |
| 2005/0284633 | A1 | 12/2005 | Richard | |
| 2006/0042801 | A1 | 3/2006 | Hackworth et al. | |
| 2006/0090903 | A1 | 5/2006 | Gano et al. | |
| 2006/0108114 | A1 | 5/2006 | Johnson | |
| 2006/0124310 | A1 | 6/2006 | Lopez de Cardenas et al. | |
| 2006/0175065 | A1 * | 8/2006 | Ross | 166/386 |
| 2006/0185849 | A1 | 8/2006 | Edwards et al. | |
| 2006/0186601 | A1 | 8/2006 | Lopez | |
| 2007/0012436 | A1 | 1/2007 | Freyer | |
| 2007/0114018 | A1 | 5/2007 | Brezinski et al. | |
| 2007/0131422 | A1 | 6/2007 | Gatlin et al. | |
| 2007/0131434 | A1 | 6/2007 | MacDougall et al. | |
| 2007/0257405 | A1 | 11/2007 | Freyer | |
| 2007/0272411 | A1 | 11/2007 | Lopez De Cardenas et al. | |
| 2008/0006405 | A1 | 1/2008 | Rickman et al. | |
| 2008/0035349 | A1 | 2/2008 | Richard | |
| 2008/0078561 | A1 | 4/2008 | Chalker et al. | |
| 2008/0093086 | A1 | 4/2008 | Courville et al. | |
| 2008/0125335 | A1 | 5/2008 | Bhavsar | |
| 2008/0149351 | A1 | 6/2008 | Marya et al. | |
| 2008/0156492 | A1 | 7/2008 | Bosma et al. | |
| 2008/0194717 | A1 | 8/2008 | Vaidya et al. | |
| 2008/0217002 | A1 | 9/2008 | Simonds et al. | |
| 2008/0283240 | A1 * | 11/2008 | Baaijens et al. | 166/236 |
| 2009/0173490 | A1 * | 7/2009 | Dusterhoft et al. | 166/229 |
| 2009/0173497 | A1 * | 7/2009 | Dusterhoft | 166/276 |
| 2009/0272525 | A1 * | 11/2009 | Nutley et al. | 166/241.6 |
| 2010/0051262 | A1 * | 3/2010 | Dusterhoft et al. | 166/236 |
| 2010/0051270 | A1 * | 3/2010 | Dusterhoft et al. | 166/278 |
| 2010/0051271 | A1 * | 3/2010 | Gano et al. | 166/278 |
| 2010/0077594 | A1 * | 4/2010 | Richard | 29/505 |

FOREIGN PATENT DOCUMENTS

| | | |
|---|---|---|
| WO | 2003052238 | 7/2003 |
| WO | 2004018836 | 3/2004 |
| WO | 2004022911 | 3/2004 |
| WO | 2005056977 | 6/2005 |
| WO | 2005100743 | 10/2005 |
| WO | 2005124091 | 12/2005 |
| WO | 2006003113 | 1/2006 |
| WO | 2006113500 | 10/2006 |
| WO | 2006003112 | 12/2006 |
| WO | 2008122809 | 3/2007 |
| WO | 2007092082 | 8/2007 |
| WO | 2007092083 | 8/2007 |
| WO | 2007126496 | 11/2007 |
| WO | 2008070674 | 6/2008 |
| WO | 2008122809 | 10/2008 |
| WO | 2009001073 | 12/2008 |

OTHER PUBLICATIONS

Cleanable Media Products; http://www.purloator-facet.com/media.htm; (Nov. 27, 2007); (pp. 1-3).

Karen Bybee; Swelling Packers Solve Zonal-Isolation Challenge in Oman High-Pressure Wells; HP/HT hallenges article; (Mar. 2007); (pp. 75-79).

Teleperf Technology; Baker Hughes Incorporated; (pp. 1-3) (Undated but admitted prior art).

International Search Report and Written Opinion, International Searching Authority European Patent Office, Aug. 5, 2009.

International Search Report and Written Opinion—PCT/US2009/054957, International Searching Authority, Dec. 12, 2009.

PCT Search Report and Written Opinion (Oct. 29, 2009).

* cited by examiner

SAND CONTROL SCREEN ASSEMBLY AND METHOD FOR USE OF SAME

TECHNICAL FIELD OF THE INVENTION

This invention relates, in general, to controlling the production of particulate materials from a subterranean formation and, in particular, to a sand control screen assembly having a swellable material layer that is operable to radially expand to place a filter medium in contact with the formation.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate materials. For example, the particulate materials cause abrasive wear to components within the well, such as tubing, flow control devices and safety devices. In addition, the particulate materials may partially or fully clog the well creating the need for an expensive workover. Also, if the particulate materials are produced to the surface, they must be removed from the hydrocarbon fluids by processing equipment at the surface.

One method for preventing the production of such particulate materials is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material, such as gravel, is then pumped down the work string and into the well annulus formed between the sand control screen and the perforated well casing or open hole production zone.

The liquid carrier either flows into the formation, returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in extended or deviated wellbores including wellbores having long, horizontal production intervals. These incomplete packs are commonly a result of the liquid carrier entering a permeable portion of the production interval causing the gravel to dehydrate and form a sand bridge in the annulus. Thereafter, the sand bridge prevents the slurry from flowing to the remainder of the annulus which, in turn, prevents the placement of sufficient gravel in the remainder of the production interval.

In addition, it has been found that gravel packing is not feasible in certain open hole completions. Attempts have been made to use expandable metal sand control screens in such open hole completions. These expandable metal sand control screens are typically installed in the wellbore then radially expanded using a hydraulic swage or cone that passes through the interior of the screen or other metal forming technique. In addition to filtering particulate materials out of the formation fluids, one benefit of these expandable sand control screens is the radial support they provide to the formation which helps prevent formation collapse. It has been found, however, that conventional expandable sand control screens do not contact the wall of the wellbore along their entire length as the wellbore profile is not uniform. More specifically, due to the process of drilling the wellbore and heterogeneity of the downhole strata, washouts or other irregularities commonly occur which result in certain locations within the wellbore having larger diameters than other areas or having non circular cross sections. Thus, when the expandable sand control screens are expanded, voids are created between the expandable sand control screens and the irregular areas of the wellbore, which has resulted in incomplete contact between the expandable sand control screens and the wellbore. In addition, with certain conventional expandable sand control screens, the threaded connections are not expandable which creates a very complex profile, at least a portion of which does not contact the wellbore. Further, when conventional expandable sand control screens are expanded, the radial strength of the expanded screens is drastically reduced resulting in little, if any, radial support to the borehole.

Therefore, a need has arisen for a sand control screen assembly that prevents the production of particulate materials from a well that traverses a hydrocarbon bearing subterranean formation without the need for performing a gravel packing operation. A need has also arisen for such a sand control screen assembly that interventionlessly provides radial support to the formation without the need for expanding metal tubulars. Further, a need has arisen for such a sand control screen assembly that is suitable for operation in long, horizontal, open hole completions.

SUMMARY OF THE INVENTION

The present invention disclosed herein comprises a sand control screen assembly that prevents the production of particulate materials from a well that traverses a hydrocarbon bearing subterranean formation or operates as an injection well. The sand control screen assembly of the present invention achieves this result without the need for performing a gravel packing operation. In addition, the sand control screen assembly of the present invention interventionlessly provides radial support to the formation without the need for expanding metal tubulars. Further, the sand control screen assembly of the present invention is suitable for operation in open hole completions in long, horizontal production intervals.

In one aspect, the present invention is directed to a sand control screen assembly that is operable to be positioned within a wellbore. The sand control screen assembly includes a base pipe having at least one opening in a sidewall portion thereof. A filter medium is disposed exteriorly of at least a first circumferential portion of the base pipe. The filter medium is in fluid communication with the at least one opening. A swellable material layer is disposed exteriorly of a second circumferential portion of the base pipe such that in response to contact with an activating fluid, radial expansion of the swellable material layer causes the filter medium to be displaced toward a surface of the wellbore and preferably in close proximity to or contact with the wellbore.

In one embodiment, the filter medium circumferentially extends around the first and second circumferential portions of the base pipe. In another embodiment, the filter medium circumferentially extends around only the first circumferential portion of the base pipe. In certain embodiments, the first circumferential portion is between about 10 degrees and about 180 degrees and may preferably be about 120 degrees.

In one embodiment, the filter medium is a single or multiple layer woven wire or fiber mesh. In other embodiments, the filter medium may be a wire wrapped screen, prepack screen, ceramic screens, fluid porous, particulate resistant sintered or diffusion bonded wire mesh screen or the like.

In one embodiment, the swellable material layer is thicker proximate a midpoint of the second circumferential portion of the base pipe than proximate an endpoint of the second circumferential portion of the base pipe. In another embodiment, the swellable material layer is circumferentially segmented. In a further embodiment, the swellable material layer is helically disposed exteriorly of the base pipe. In yet another embodiment, swellable material segments may be placed between the base pipe and the filter medium such that the filter medium is radially outwardly displaced in response to contact with an activating fluid by the swellable material segments. In certain embodiments, the activating fluid may be a water based fluid, a hydrocarbon fluid, such as an oil or a gas or combinations thereof.

In another aspect, the present invention is directed to a sand control screen assembly that is operable to be positioned within a wellbore. The sand control screen assembly includes a base pipe having at least one opening in a sidewall portion thereof. A filter medium is disposed exteriorly of at least a first circumferential portion of the base pipe. The filter medium is in fluid communication with the at least one opening. A swellable material layer is disposed exteriorly of a second circumferential portion of the base pipe. The swellable material layer is thicker proximate a midpoint of the second circumferential portion of the base pipe than proximate an endpoint of the second circumferential portion of the base pipe such that in response to contact with an activating fluid, radial expansion of the swellable material layer causes the filter medium to contact the wellbore.

In a further aspect, the present invention is directed to a method of installing a sand control screen assembly in a wellbore. The method includes running the sand control screen assembly to a target location within the wellbore, the sand control screen assembly having a filter medium disposed exteriorly of at least a first circumferential portion of a base pipe, contacting a swellable material layer disposed exteriorly of a second circumferential portion of the base pipe with an activating fluid, radially expanding the swellable material layer in response to contact with the activating fluid and displacing the filter medium toward a surface of the wellbore in response to the radial expansion of the swellable material layer.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1A:
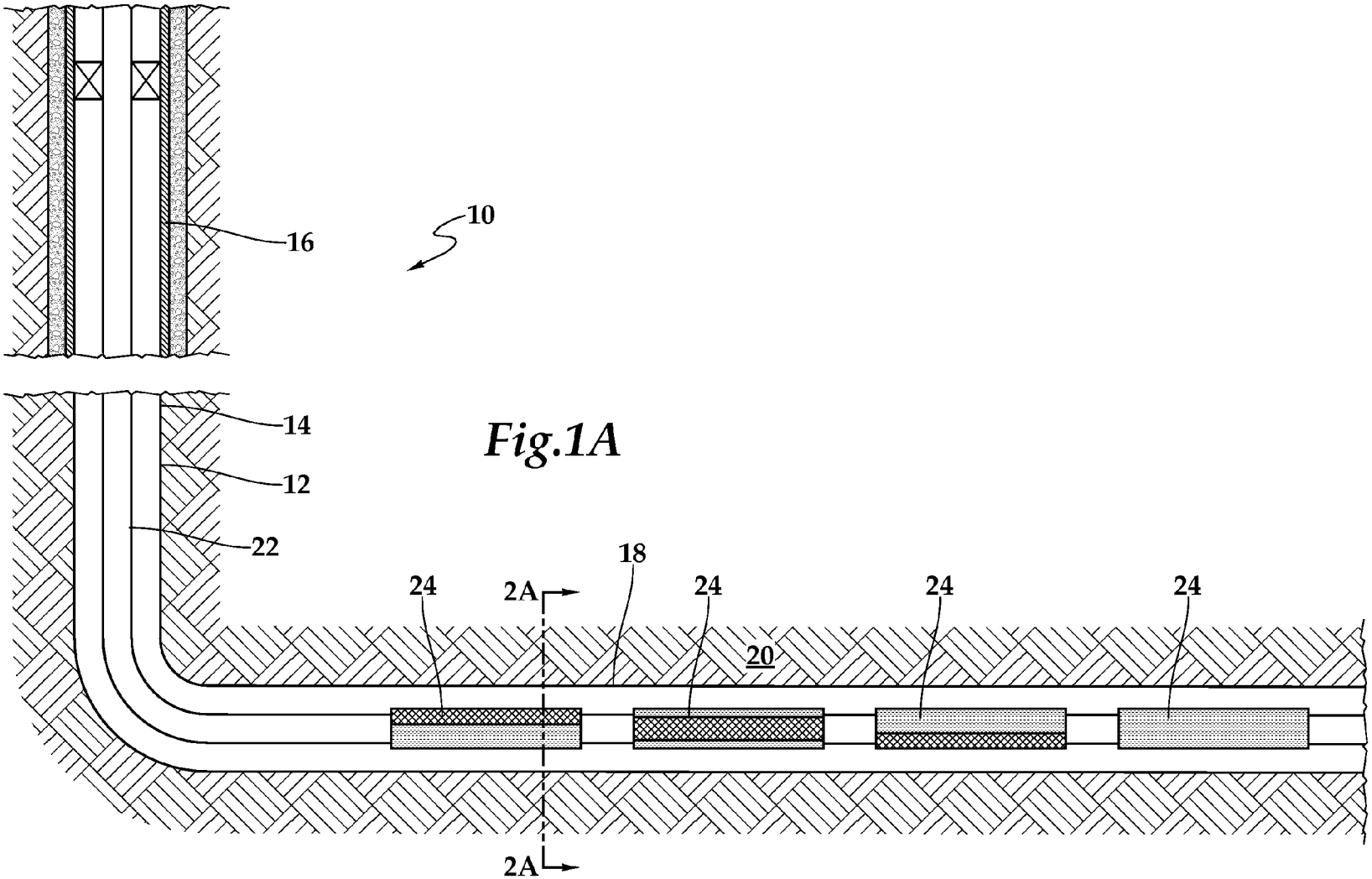
FIG. 1A is a schematic illustration of a well system operating a plurality of sand control screen assemblies in a running configuration according to an embodiment of the present invention.

Referring initially to FIG. 1A, therein is depicted a well system including a plurality of sand control screen assemblies embodying principles of the present invention that is schematically illustrated and generally designated 10. In the illustrated embodiment, a wellbore 12 extends through the various earth strata. Wellbore 12 has a substantially vertical section 14, the upper portion of which has installed therein a casing string 16 that is cemented within wellbore 12. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. Positioned within tubing string 22 is a plurality of sand control screen assemblies 24. The sand control screen assemblies 24 are shown in a running or unextended configuration.

Figure 1B:
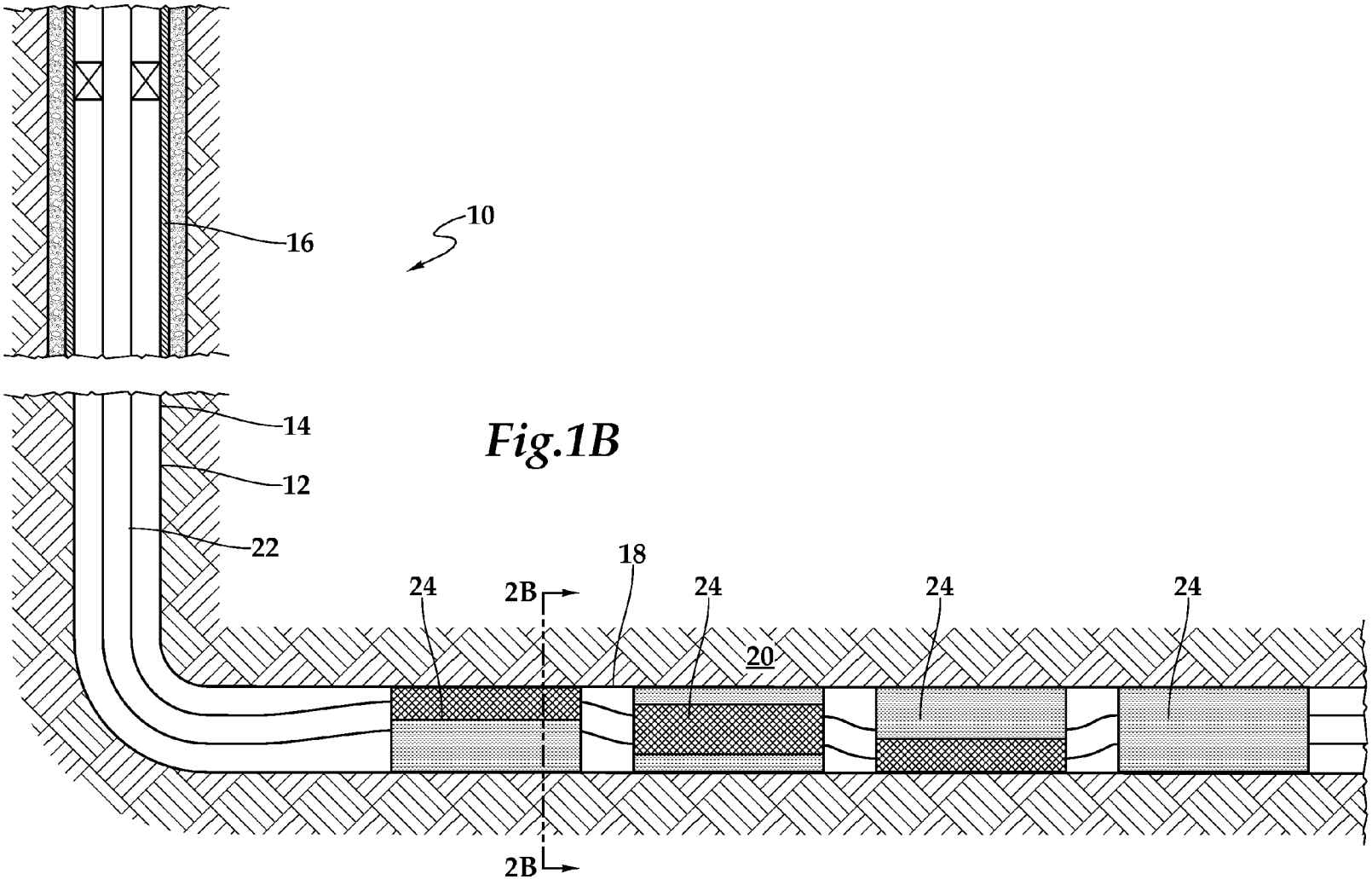
FIG. 1B is a schematic illustration of a well system operating a plurality of sand control screen assemblies in an operating configuration according to an embodiment of the present invention.

Referring also to FIG. 1B, therein is depicted the well system of FIG. 1A with sand control screen assemblies 24 in their radially expanded configuration. As explained in greater detail below, each of the depicted sand control screen assemblies 24 has a base pipe, a filter medium and a swellable material layer. In general, the filter medium is exposed relative to one circumferential portion of each sand control screen assembly and the swellable material layer is disposed exteriorly of another circumferential portion of each sand control screen assembly. When sand control screen assemblies 24 come in contact with an activating fluid, such as a hydrocarbon fluid, water or a gas, the swellable material layer of each sand control screen assembly radially expands which in turn causes the filter medium of each sand control screen assemblies 24 to contact the surface of wellbore 12. In the illustrated embodiment, adjacent sand control screen assemblies 24 are rotated relative to one another by 90 degrees. This configuration assures the various filter media will be oriented around the entire circumference of wellbore 12 including having at least some of the filter media contacting the top of wellbore 12. Other relative circumferential orientations of adjacent sand control screen assemblies 24 are also possible and considered within the scope of the present invention, those circumferential orientations including, but not limited to, relative rotations of between about 30 degrees and 180 degrees.

Even though FIGS. 1A-1B, depict tubing string 22 as including only sand control screen assemblies 24, those skilled in the art will recognize that tubing string 22 may include any number of other tools and systems. For example, tubing string 22 may be divided into a plurality of intervals using zonal isolation devices such as packers. Similar to the swellable materials in sand control screen assemblies 24, these zonal isolation devices may be made from materials that swell upon contact with a fluid, such as an inorganic or organic fluid. Some exemplary fluids that may cause the zonal isolation devices to swell and isolate include water, gas and hydrocarbons.

In addition, even though FIGS. 1A-1B depict the sand control screen assemblies of the present invention in a horizontal section of the wellbore, it should be understood by those skilled in the art that the sand control screen assemblies of the present invention are equally well suited for use in deviated or vertical wellbores. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 2A:
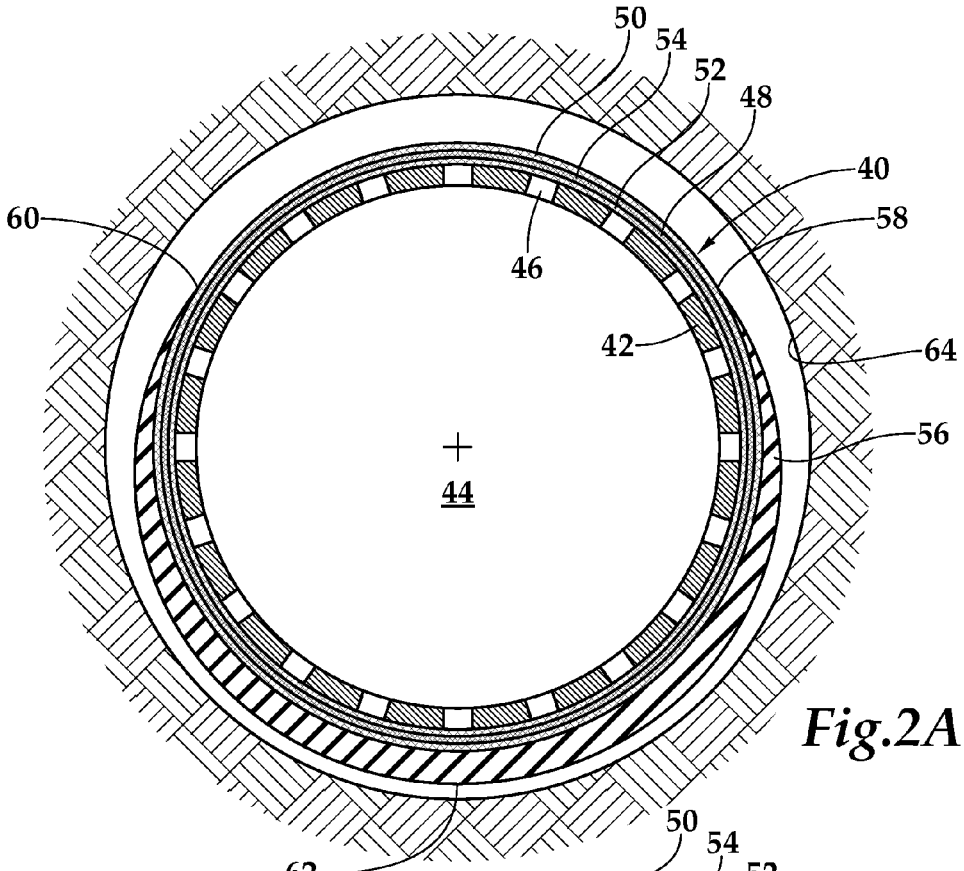
FIG. 2A is a cross sectional view taken along line 2A-2A of a sand control screen assembly of FIG. 1A in a running configuration according to an embodiment of the present invention.

Referring to FIG. 2A, therein is depicted a cross sectional view of a sand control screen assembly in its running configuration that embodies principles of the present invention and is generally designated 40. Sand control screen assembly 40 includes base pipe 42 that defines an internal flow path 44. Base pipe 42 has a plurality of openings 46 that allow fluid to pass between the exterior of base pipe 42 and internal flow path 44. Disposed around base pipe 42 is a filter medium 48. Filter medium 48 may comprise a mechanical screening element such as a fluid-porous, particulate restricting, metal screen having a plurality of layers of woven wire mesh that may be diffusion bonded or sintered together to form a porous wire mesh screen designed to allow fluid flow therethrough but prevent the flow of particulate materials of a predetermined size from passing therethrough. In the illustrated embodiment, filter medium 48 includes outer and inner drainage layers 50, 52 that have a relatively course wire mesh with a filtration layer 54 disposed therebetween having a relatively fine mesh. It should be noted that other types of drainage layers may alternatively be used. For example, one of both drainage layers may be formed from a wire wrap, a perforated shroud or the like. Likewise, filter medium 48 may be formed from other types of sand control medium, such as a wire wrapped screen, a prepack screen, ceramic screen, metallic beads such as stainless steel beads or sintered stainless steel beads and the like. Filter medium 48 is sized according to the particular requirements of the production zone into which it will be installed. Some exemplary sizes of the gaps in the filter media 48 may be in the 20-250 standard mesh range.

Preferably, at least filtration layer 54 has a sealing substance therein, for example, by impregnating the filtration layer 54 with the sealing substance, so that the sealing substance fills voids in filtration layer 54 to prevent plugging during installation. Any of the other layers 50, 52 or base pipe 42 could alternatively have the sealing substance applied thereto, in keeping with the principles of the invention. For example, the sealing substance could block fluid flow through the perforation 46 of base pipe 42, or the sealing substance could be impregnated in the wire mesh of the drainage layers 50, 52, or any combination of the above.

Preferably, the sealing substance is degradable when exposed to a subterranean well environment. More preferably, the sealing substance degrades when exposed to water at an elevated temperature in a well. Most preferably, the sealing substance is provided as described in U.S. Pat. No. 7,036,587 which is hereby incorporated by reference for all purposes.

The sealing substance may be a degradable polymer. Suitable examples of degradable polymers that may be used in accordance with the present invention include polysaccharides such as dextran or cellulose; chitins; chitosans; proteins; aliphatic polyesters; poly(lactides); poly(glycolides); poly(ε-caprolactones); poly(anhydrides); poly(hydroxybutyrates); aliphatic polycarbonates; poly(orthoesters); poly(amino acids); polyethylene oxides); and polyphosphazenes. Of these suitable polymers, aliphatic polyesters such as poly (lactide) or poly(lactic acid) and polyanhydrides are preferred.

The sealing substance may degrade in the presence of a hydrated organic or inorganic compound solid, which may be included in the filter medium 48, so that a source of water is available in the well when the screens are installed. For example, the hydrated organic or inorganic compound could be provided in the wire mesh of the drainage layers 50, 52. Alternatively, another water source may be delivered to the sealing substance after sand control screen assembly 40 is conveyed into the well, such as by circulating the water source down to the well or formation water may be used as the water source.

Positioned around a portion of filter medium 48 is a swellable material layer 56. Swellable material layer 56 is attached to filter medium 48 by bonding or other suitable technique. In the illustrated embodiment, swellable material layer 56 gets progressively thicker from each of its endpoints 58, 60 to its midpoint 62. The thickness of swellable material layer 56 may transition linearly or non-linearly between midpoint 62 and endpoints 58, 60. Preferably, the thickness of the swellable material layer 56 is optimized based upon the diameter of sand control screen assembly 40 and the diameter of wellbore 64 such that upon expansion, as explained in greater detail below, substantially uniform contact between both swellable material layer 56 and filter medium 48 with the surface of wellbore 64 is achieved. In the illustrated embodiment, swellable material layer 56 surrounds about 240 degrees of the circumference of sand control screen assembly 40. A corresponding 120 degrees of filter medium 48 is therefore exposed.

Figure 2B:
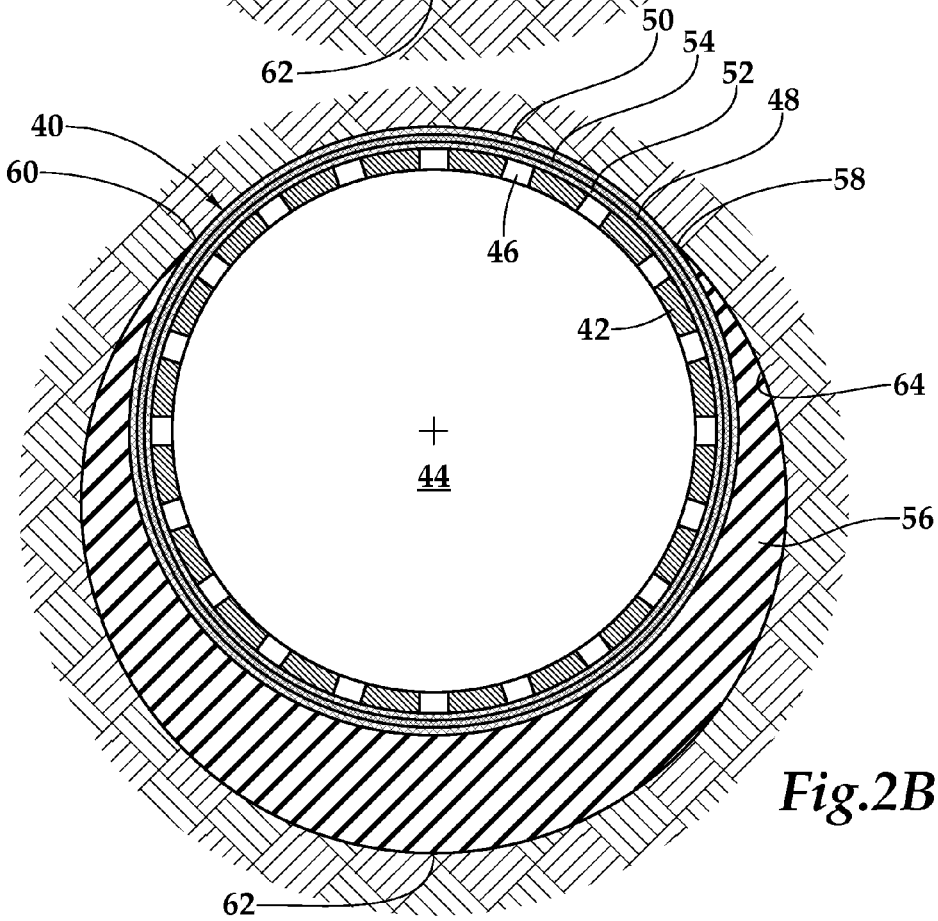
FIG. 2B is a cross sectional view taken along line 2B-2B of a sand control screen assembly of FIG. 1B in an operating configuration according to an embodiment of the present invention.

Referring additionally now to FIG. 2B, therein is depicted a cross sectional view of sand control screen assembly 40 in its operating configuration. In the illustrated embodiment, swellable material layer 56 has come in contact with an activating fluid, such as a hydrocarbon fluid, water or gas, which has caused swellable material layer 56 to radially expand into contact with the surface of the wellbore 64, which, in the illustrated embodiment, is the formation face. In addition, the radial expansion of swellable material layer 56 has caused filter medium 48 to come into contact with the surface of the wellbore 64. In this embodiment, outer drainage layer 50 provides a stand off region between filtration layer 54 and wellbore 64. The use of this configuration is beneficial, for example, if a filter cake has previously formed on the surface of the formation, then the stand off will prevent damage to filtration layer 54 and allow removal of the filter cake using acid or other reactive fluid.

A further benefit provided by the sand control screen assemblies of the present invention is that in addition to providing a path for formation fluids to enter internal flow path, the sand control screen assemblies of the present invention also provide support to formation to prevent formation collapse. Compared with convention expandable metal sand control screens as discussed above, the sand control screen assemblies of the present invention provide improved contact with the formation as greater radial expansion is achievable and the swellable material layer is more compliant such that it is better able to conform to a nonuniform wellbore face. In a preferred implementation, the sand control screen assemblies of the present invention provide between about 500 psi and 2000 psi or more of collapse support to the wellbore. Those skilled in the art will recognize that the collapse support provided by the present invention can be optimized for a particular implementation though specific design features of the base pipe, the swellable material layer and the filter medium.

Various techniques may be used for contacting swellable material layer 56 with appropriate activating fluid for causing swelling of swellable material layer 56. For example, the activating fluid may already be present in the well when sand control screen assembly 40 is installed in the well, in which case swellable material layer 56 preferably include a mechanism for delaying the swelling of swellable material layer 56 such as an absorption delaying or preventing coating or membrane, swelling delayed material compositions or the like.

Alternatively, the activating fluid may be circulated through the well to swellable material layer 56 after sand control screen assembly 40 is installed in the well. As another alternative, the activating fluid may be produced into the wellbore from the formation surrounding the wellbore. Thus, it will be appreciated that any method may be used for causing swelling of swellable material layer 56 of sand control screen assembly 40 in keeping with the principles of the invention.

Swellable material layer 56 is formed from one or more materials that swell when contacted by an activation fluid, such as an inorganic or organic fluid. For example, the material may be a polymer that swells multiple times its initial size upon activation by an activation fluid that stimulates the material to expand. In one embodiment, the swellable material is a material that swells upon contact with and/or absorption of a hydrocarbon, such as an oil or a gas. The hydrocarbon is absorbed into the swellable material such that the volume of the swellable material increases creating a radial expansion of the swellable material when positioned around a base pipe which causes base pipe 42 and filter media 48 to be eccentrically positioned within wellbore 64. Preferably, the swellable material will swell until its outer surface and filter media 48 contact the formation face in an open hole completion or the casing wall in a cased wellbore. The swellable material accordingly provides the energy to position filter media 48 in contact with the formation.

Some exemplary swellable materials include elastic polymers, such as EPDM rubber, styrene butadiene, natural rubber, ethylene propylene monomer rubber, ethylene propylene diene monomer rubber, ethylene vinyl acetate rubber, hydrogenized acrylonitrile butadiene rubber, acrylonitrile butadiene rubber, isoprene rubber, chloroprene rubber and polynorbornene. These and other swellable materials swell in contact with and by absorption of hydrocarbons so that the swellable materials expand. In one embodiment, the rubber of the swellable materials may also have other materials dissolved in or in mechanical mixture therewith, such as fibers of cellulose. Additional options may be rubber in mechanical mixture with polyvinyl chloride, methyl methacrylate, acrylonitrile, ethylacetate or other polymers that expand in contact with oil.

In another embodiment, the swellable material is a material that swells upon contact with water. In this case, the swellable material may be a water-swellable polymer such as a water-swellable elastomer or water-swellable rubber. More specifically, the swellable material may be a water-swellable hydrophobic polymer or water-swellable hydrophobic copolymer and preferably a water-swellable hydrophobic porous copolymer. Other polymers useful in accordance with the present invention can be prepared from a variety of hydrophilic monomers and hydrophobically modified hydrophilic monomers. Examples of particularly suitable hydrophilic monomers which can be utilized include, but are not limited to, acrylamide, 2-acrylamido-2-methyl propane sulfonic acid, N,N-dimethylacrylamide, vinyl pyrrolidone, dimethylaminoethyl methacrylate, acrylic acid, trimethylammoniumethyl methacrylate chloride, dimethylaminopropylmethacrylamide, methacrylamide and hydroxyethyl acrylate.

A variety of hydrophobically modified hydrophilic monomers can also be utilized to form the polymers useful in accordance with this invention. Particularly suitable hydrophobically modified hydrophilic monomers include, but are not limited to, alkyl acrylates, alkyl methacrylates, alkyl acrylamides and alkyl methacrylamides wherein the alkyl radicals have from about 4 to about 22 carbon atoms, alkyl dimethylammoniumethyl methacrylate bromide, alkyl dimethylammoniumethyl methacrylate chloride and alkyl dimethylammoniumethyl methacrylate iodide wherein the alkyl radicals have from about 4 to about 22 carbon atoms and alkyl dimethylammonium-propylmethacrylamide bromide, alkyl dimethylammonium propylmethacrylamide chloride and alkyl dimethylammonium-propylmethacrylamide iodide wherein the alkyl groups have from about 4 to about 22 carbon atoms.

Polymers which are useful in accordance with the present invention can be prepared by polymerizing any one or more of the described hydrophilic monomers with any one or more of the described hydrophobically modified hydrophilic monomers. The polymerization reaction can be performed in various ways that are known to those skilled in the art, such as those described in U.S. Pat. No. 6,476,169 which is hereby incorporated by reference for all purposes.

Suitable polymers may have estimated molecular weights in the range of from about 100,000 to about 10,000,000 and preferably in the range of from about 250,000 to about 3,000,000 and may have mole ratios of the hydrophilic monomer(s) to the hydrophobically modified hydrophilic monomer(s) in the range of from about 99.98:0.02 to about 90:10.

Other polymers useful in accordance with the present invention include hydrophobically modified polymers, hydrophobically modified water-soluble polymers and hydrophobically modified copolymers thereof. Particularly suitable hydrophobically modified polymers include, but are not limited to, hydrophobically modified polydimethylaminoethyl methacrylate, hydrophobically modified polyacrylamide and hydrophobically modified copolymers of dimethylaminoethyl methacrylate and vinyl pyrollidone.

As another example, the swellable material may be a salt polymer such as polyacrylamide or modified crosslinked poly (meth)acrylate that has the tendency to attract water from salt water through osmosis wherein water flows from an area of low salt concentration, the formation water, to an area of high salt concentration, the salt polymer, across a semi permeable membrane, the interface between the polymer and the production fluids, that allows water molecules to pass therethrough but prevents the passage of dissolved salts therethrough.

In some embodiments, the swellable materials may be permeable to certain fluids but prevent particulate movement therethrough due to the porosity within the swellable materials. For example, the swellable material may have a pore size that is sufficiently small to prevent the passage of the sand therethrough but sufficiently large to allow hydrocarbon fluid production therethrough. For example, the swellable material may have a pore size of less than 1 mm.

Figure 3:
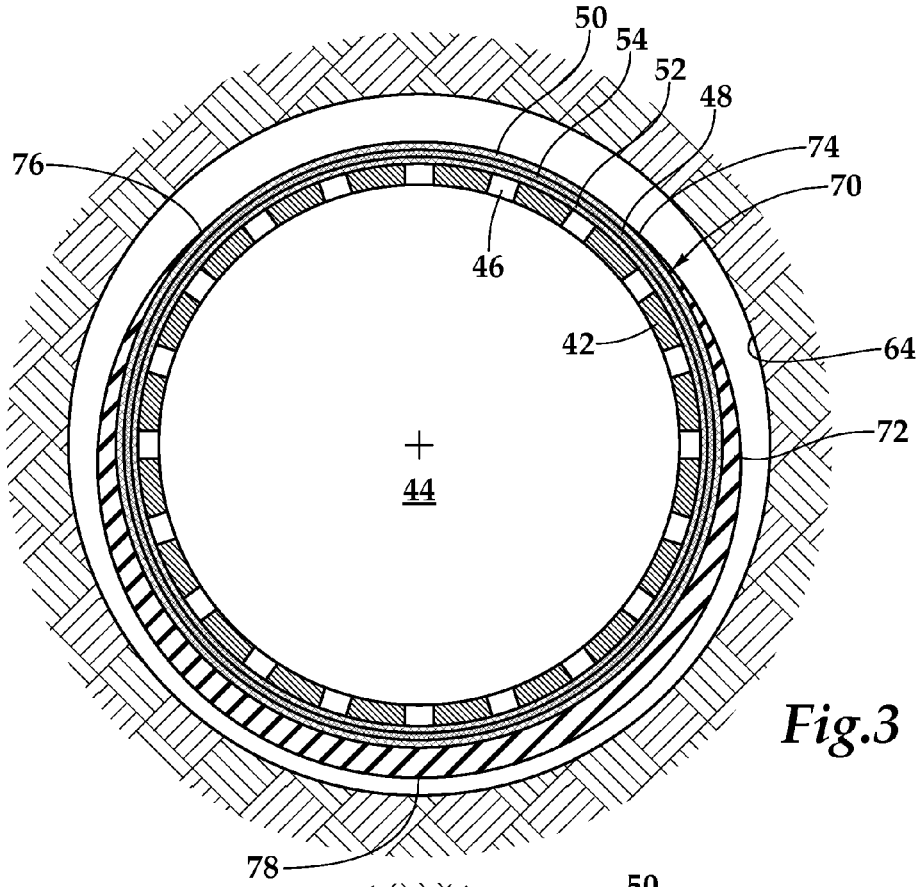
FIG. 3 is a cross sectional view of a sand control screen assembly according to an embodiment of the present invention.
Figure 4:
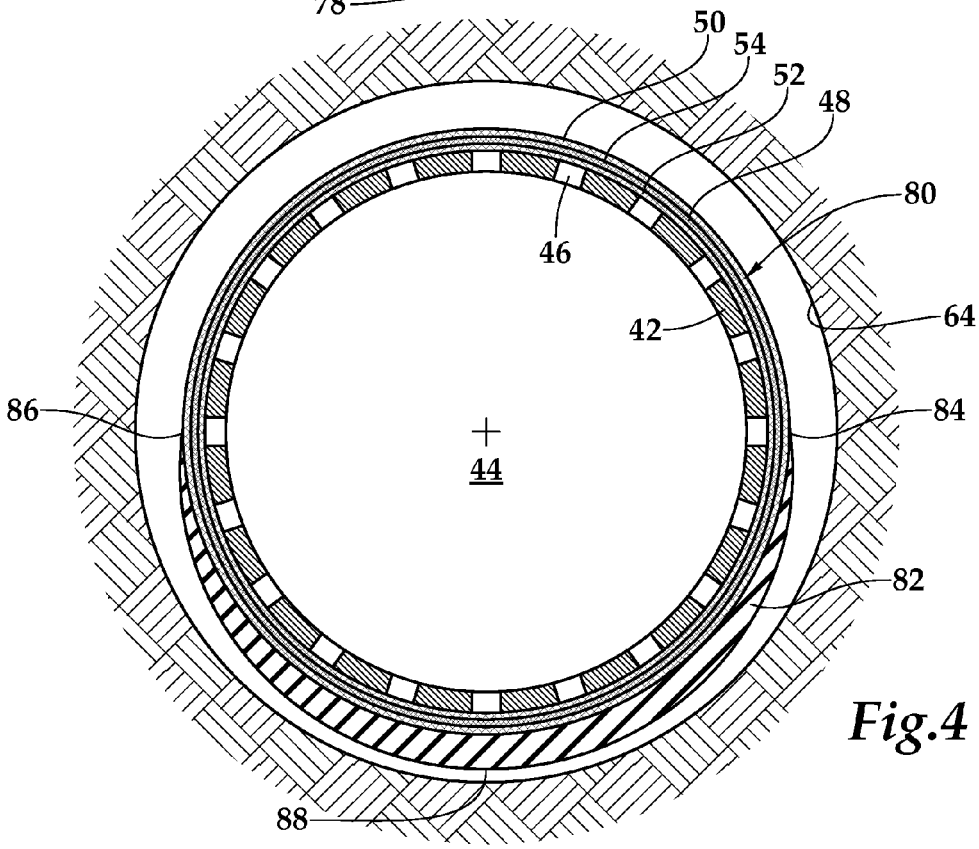
FIG. 4 is a cross sectional view of a sand control screen assembly according to an embodiment of the present invention.

Even though FIGS. 2A-2B have depicted swellable material layer 56 as surrounds about 240 degrees of the circumference of sand control screen assembly 40 and filter medium 48 being circumferentially exposed for about 120 degrees, it should be understood by those skilled in the art that other circumferential orientations are possible and are considered within the scope of the present invention. For example, circumferential filter medium exposure from between about 10 degrees to about 180 degrees is desirable. Further, as best seen in FIG. 3, sand control screen assembly 70 is depicted as having a swellable material layer 72 that surrounds about 300 degrees of the circumference of sand control screen assembly 70 with a corresponding 60 degrees of filter medium 48 being exposed. As another example, as best seen in FIG. 4, sand control screen assembly 80 is depicted as having a swellable material layer 82 that surrounds about 180 degrees of the circumference of sand control screen assembly 80 with a corresponding 180 degrees of filter medium 48 being exposed. In addition, FIG. 3 depicts swellable material layer 72 as getting progressively thicker from each of it endpoints 74, 76 to its midpoint 78. Likewise, FIG. 4 depicts swellable material layer 82 as getting progressively thicker from each of it endpoints 84, 86 to its midpoint 88.

Figure 5:
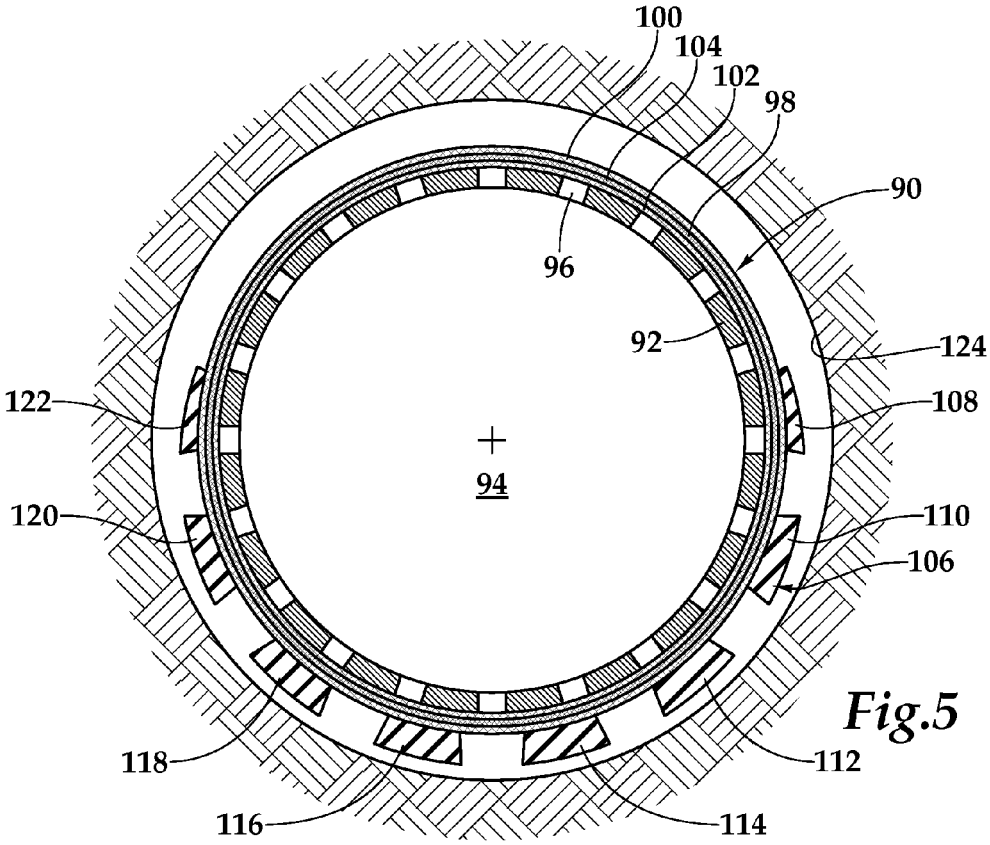
FIG. 5 is a cross sectional view of a sand control screen assembly according to an embodiment of the present invention.

Referring to FIG. 5, therein is depicted a cross sectional view of a sand control screen assembly in its running configuration that embodies principles of the present invention and is generally designated 90. Sand control screen assembly 90 includes base pipe 92 that defines an internal flow path 94. Base pipe 92 has a plurality of openings 96 that allow fluid to pass between the exterior of base pipe 92 and internal flow path 94. Disposed around base pipe 92 is a filter medium 98. Filter medium 98 includes outer and inner drainage layers 100, 102 that have a relatively course wire mesh with a filtration layer 104 disposed therebetween having a relatively fine mesh. Positioned around a portion of filter medium 98 is a swellable material layer 106, Swellable material layer 106 is attached to filter medium 98 by bonding or other suitable technique. In the illustrated embodiment, swellable material layer 106 is circumferentially segmented into a plurality of longitudinally extending columns or sections. As depicted, swellable material layer 106 includes swellable material layer sections 108, 110, 112, 114, 116, 118, 120, 122. Also, as depicted, the swellable material layer sections get progressively thicker from section 108 to section 114 and from section 122 to section 116.

In a manner similar to that described above, sand control screen assembly 90 is run downhole with swellable material layer sections 108, 110, 112, 114, 116, 118, 120, 122 in their unexpanded configuration. Upon contact with the activation fluid, such as a hydrocarbon fluid or water as described herein, swellable material layer sections 108, 110, 112, 114, 116, 118, 120, 122 radially expanded such that the outer surface of swellable material layer sections 108, 110, 112, 114, 116, 118, 120, 122 and the upper portion of filter medium 98 displaces radially toward and preferably contacts the surface of the open hole wellbore 124. Use of sand control screen assembly 90 with swellable material layer sections 108, 110, 112, 114, 116, 118, 120, 122 allows for more of the filter medium 98 to be exposed to production. In addition, the gaps between material layer sections 108, 110, 112, 114, 116, 118, 120, 122 allow for control lines or other conduits that carry data, signals, power, optics, fluids or the like to be running association with sand control screen assembly 90. It should be noted, however, that slots or other routing paths could be formed in the other embodiments of the swellable material layer described herein, such slots including, but not limited to, those described in United States Application Publication Number US 2007-0012436 A1, which is hereby incorporated by reference for all purposes.

Figure 6:
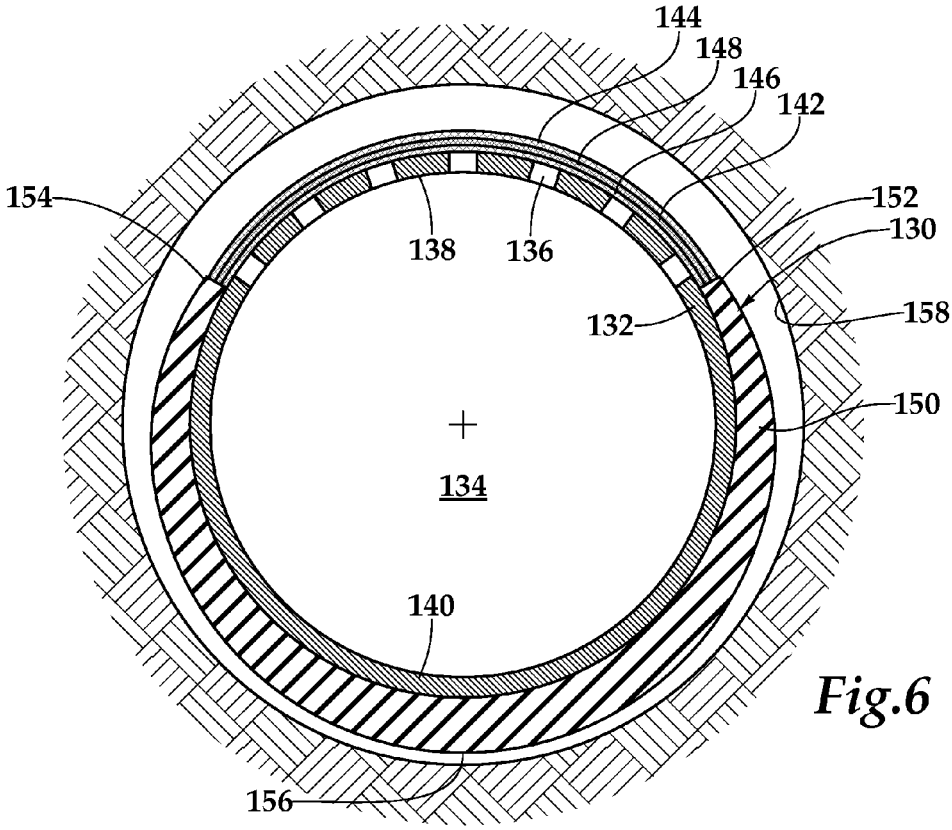
FIG. 6 is a cross sectional view of a sand control screen assembly according to an embodiment of the present invention.

Referring to FIG. 6, therein is depicted a cross sectional view of a sand control screen assembly in its running configuration that embodies principles of the present invention and is generally designated 130. Sand control screen assembly 130 includes base pipe 132 that defines an internal flow path 134. Base pipe 132 has a plurality of openings 136 in a perforated circumferential section 138 of base pipe 132 that allows fluid to pass between the exterior of base pipe 132 and internal flow path 134. Base pipe 132 also has a non perforated circumferential section or blank pipe section 140. Disposed around perforated section 138 of base pipe 132 is a filter medium 142. Filter medium 142 includes outer and inner drainage layers 144, 146 that have a relatively course wire mesh with a filtration layer 148 disposed therebetween having a relatively fine mesh. Positioned around blank pipe section 140 of base pipe 132 is a swellable material layer 150. Swellable material layer 150 is attached to base pipe 132 by bonding or other suitable technique. In the illustrated embodiment, swellable material layer 150 gets progressively thicker from each of it endpoints 152, 154 to its midpoint 156.

In a manner similar to that described above, sand control screen assembly 130 is run downhole with swellable material layer 150 in its unexpanded configuration. Upon contact with the activation fluid, such as a hydrocarbon fluid or water as described herein, swellable material layer 150 is radially expanded such that the outer surface of swellable material layer 150 and filter medium 142 displaces radially toward and preferably contacts the surface of the open hole wellbore 158.

Figure 7:
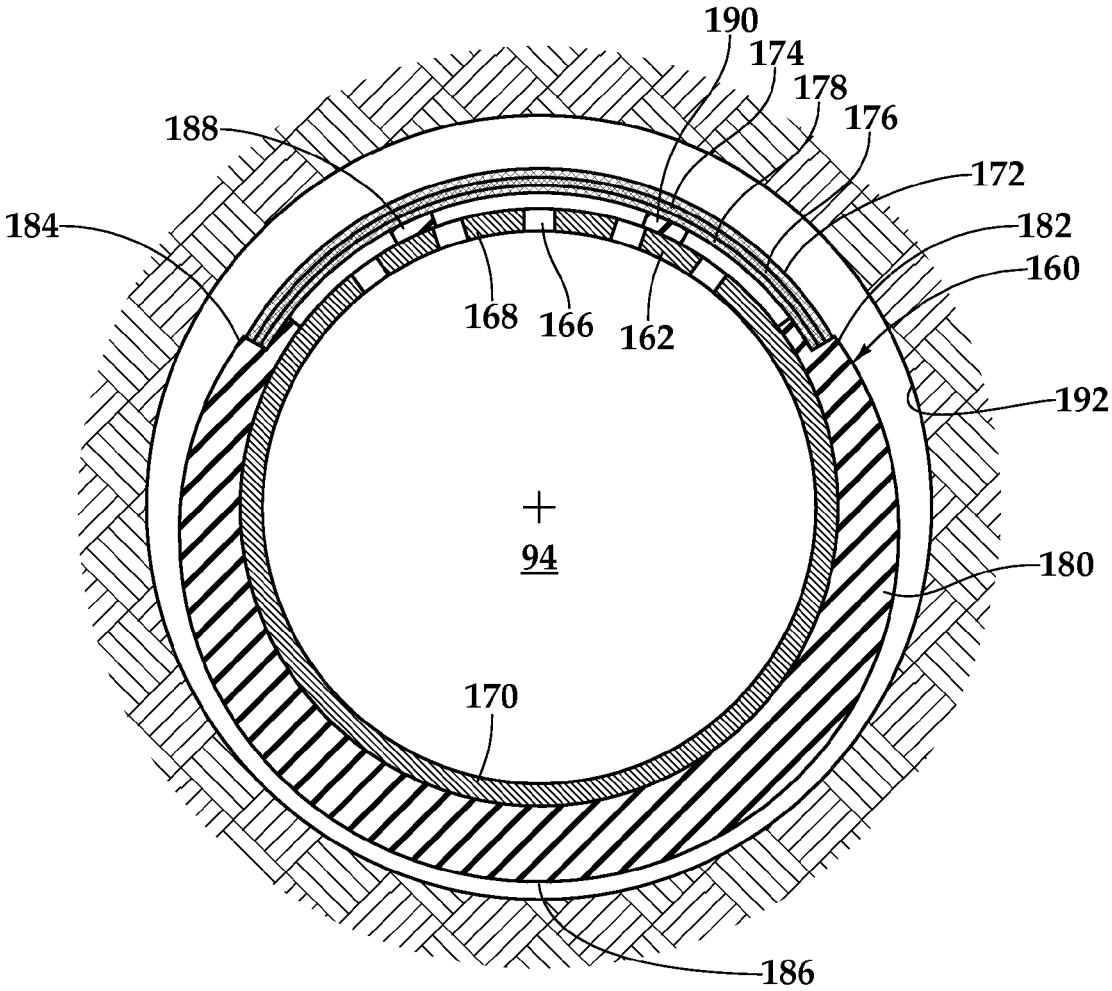
FIG. 7 is a cross sectional view of a sand control screen assembly according to an embodiment of the present invention.

Referring to FIG. 7, therein is depicted a cross sectional view of a sand control screen assembly in its running configuration that embodies principles of the present invention and is generally designated 160. Sand control screen assembly 160 includes base pipe 162 that defines an internal flow path 164. Base pipe 162 has a plurality of openings 166 in a perforated circumferential section 168 that allows fluid to pass between the exterior of base pipe 162 and internal flow path 164. Base pipe 162 also has a non perforated circumferentially section or blank pipe section 170. Disposed around perforated section 168 of base pipe 162 is a filter medium 172. Filter medium 172 includes outer and inner drainage layers 174, 176 that have a relatively course wire mesh with a filtration layer 178 disposed therebetween having a relatively fine mesh. Positioned around blank pipe section 170 of base pipe 162 is a swellable material layer 180. Swellable material layer 180 is attached to base pipe 162 by bonding or other suitable technique. In the illustrated embodiment, swellable material layer 180 gets progressively thicker from each of it endpoints 182, 184 to its midpoint 186. In the illustrated embodiment, swellable material layer 180 also includes swellable material layer sections 188, 190 that are disposed between base pipe 162 and filter medium 172.

In a manner similar to that described above, sand control screen assembly 160 is run downhole with swellable material layer 180 in its unexpanded configuration. Upon contact with the activation fluid, such as a hydrocarbon fluid or water as described herein, swellable material layer 180 is radially expanded such that the outer surface of swellable material layer 180 and filter medium 172 displaces radially toward and preferably contacts the surface of the open hole wellbore 192. In the illustrated embodiment, contact between filter medium 172 and wellbore 192 is enhanced through the use of swellable material layer sections 188, 190 that radially shift filter medium 172 toward wellbore 192. In other embodiments, support similar to swellable material layer sections 188, 190 could alternatively be used to add compliance to the contact between filter medium 172 and wellbore 192. For example, such supports could be formed from a non swellable elastomer material, a crushable metallic or non metallic material, combinations of these materials or other materials that give flexibility and support to filter medium 172. Likewise, filter medium 172 may be designed to optimize compliance with the formation face.

Even though swellable material layer sections 188, 190 of swellable material layer 180 have been depicted as extending in the longitudinal direction of sand control screen assembly 160, it should be understood by those skilled in the art that sections of swellable material may be placed between base pipe 162 and filter medium 172 in a variety of configurations including, but not limited to, circumferentially extending sections, a plurality of circular or other shaped sections, a perforated sheet, a crisscross pattern and the like.

Figure 8:
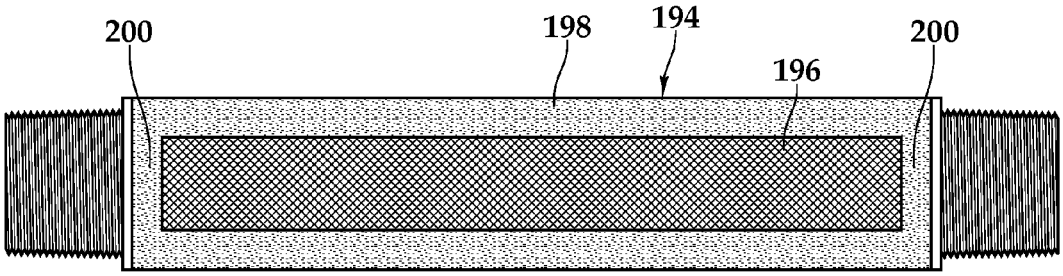
FIG. 8 is a side view of a sand control screen assembly according to an embodiment of the present invention.

Referring to FIG. 8, therein is depicted a side elevation view of a sand control screen assembly in its running configuration that embodies principles of the present invention and is generally designated 194. Sand control screen assembly 194 includes a base pipe that defines an internal flow path and a plurality of openings that allow fluid to pass between the exterior of the base pipe and the internal flow path. Exposed around approximately a 90 degree circumferential section of the base pipe is a filter medium 196. Filter medium 196 includes outer and inner drainage layers that have a relative course wire mesh with a filtration layer disposed therebetween having a relatively fine mesh. Positioned around the remaining 270 degree circumferential section of the base pipe is a swellable material layer 198. Swellable material layer 198 is attached to the base pipe or filter medium 196 by bonding or other suitable technique. As illustrated, swellable material layer 194 extends circumferentially around 360 degrees of the base pipe at the two ends 200 of sand control screen assembly 194. In this configuration, swellable material layer 198 provides isolation completely around filter medium 196 upon activation of swellable material layer 198 which places swellable material layer 198 and preferably filter medium 196 in contact with the formation.

Figure 9:
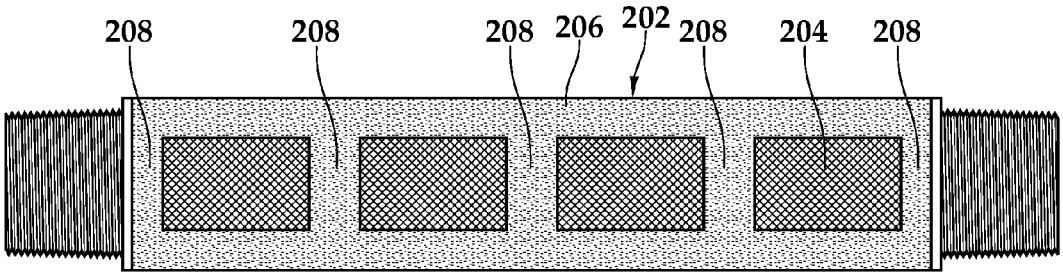
FIG. 9 is a side view of a sand control screen assembly according to an embodiment of the present invention.

Referring to FIG. 9, therein is depicted a side elevation view of a sand control screen assembly in its running configuration that embodies principles of the present invention and is generally designated 202. Sand control screen assembly 202 includes a base pipe that defines an internal flow path and a plurality of openings that allow fluid to pass between the exterior of the base pipe and the internal flow path. Exposed around approximately a 90 degree circumferential section of the base pipe is a filter medium 204. Filter medium 204 includes outer and inner drainage layers that have a relative course wire mesh with a filtration layer disposed therebetween having a relatively fine mesh. Positioned around the remaining 270 degree circumferential section of the base pipe is a swellable material layer 206. Swellable material layer 206 is attached to the base pipe, to filter medium 204 or both by bonding or other suitable technique. As illustrated, swellable material layer 206 includes a plurality of band 208 that extend circumferentially around 360 degrees of the base pipe. In this configuration, swellable material layer 206 provides isolation completely around multiple sections of filter medium 204 upon activation of swellable material layer 206 which places swellable material layer 206 and preferably filter medium 204 in contact with the formation. In this configuration, the use of packers or other sealing devices in conjunction with one or more sand control screen assemblies 202 may be reduced or eliminated.

Figure 10:
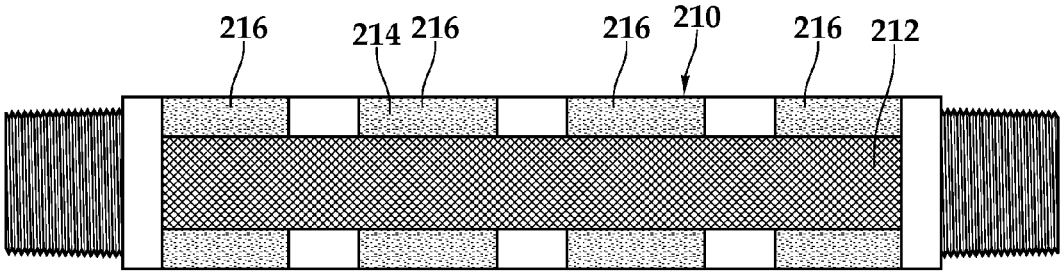
FIG. 10 is a side view of a sand control screen assembly according to an embodiment of the present invention.

Referring to FIG. 10, therein is depicted a side elevation view of a sand control screen assembly in its running configuration that embodies principles of the present invention and is generally designated 210. Sand control screen assembly 210 includes a base pipe that defines an internal flow path and a plurality of openings that allow fluid to pass between the exterior of the base pipe and the internal flow path. Exposed around approximately a 90 degree circumferential section of the base pipe is a filter medium 212. Filter medium 212 includes outer and inner drainage layers that have a relative course wire mesh with a filtration layer disposed therebetween having a relatively fine mesh. Positioned around the remaining 270 degree circumferential section of the base pipe is a swellable material layer 214. Swellable material layer 214 is attached to the base pipe or filter medium 212 by bonding or other suitable technique. As illustrated, swellable material layer 214 is formed from a plurality of longitudinally segmented sections 216. In this configuration, formation fluids from around the entire circumference of sand control screen assembly 210 may enter the wellbore at the locations between segmented sections 216 of swellable material layer 214 even after activation of swellable material layer 214 which places swellable material layer 214 and preferably filter medium 212 in contact with the formation.

Figure 11:
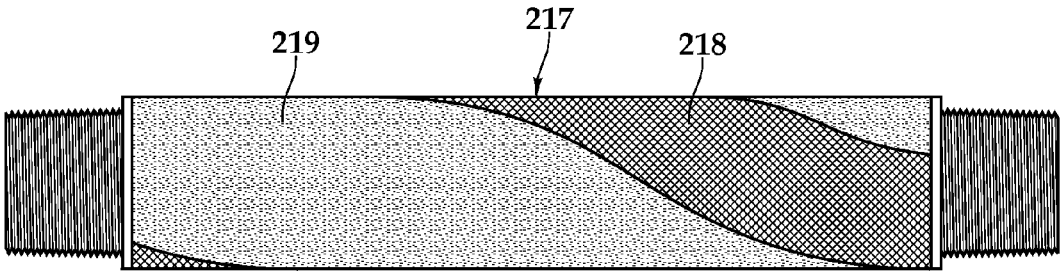
FIG. 11 is a side view of a sand control screen assembly according to an embodiment of the present invention.

Referring to FIG. 11, therein is depicted a side elevation view of a sand control screen assembly in its running configuration that embodies principles of the present invention and is generally designated 217. Sand control screen assembly 217 includes a base pipe that defines an internal flow path and a plurality of openings that allow fluid to pass between the exterior of the base pipe and the internal flow path. Exposed around approximately a 120 degree circumferential section of the base pipe is a filter medium 218. Filter medium 218 includes outer and inner drainage layers that have a relative course wire mesh with a filtration layer disposed therebetween having a relatively fine mesh. Positioned around the remaining 240 degree circumferential section of the base pipe is a swellable material layer 219. Swellable material layer 219 is attached to filter medium 218 by bonding or other suitable technique. As illustrated, swellable material layer 219 is disposed around sand control screen assembly 217 in a spiral or helical configuration. In this configuration, fluids from the entire circumference of the wellbore can more easily be produced.

Figure 12:
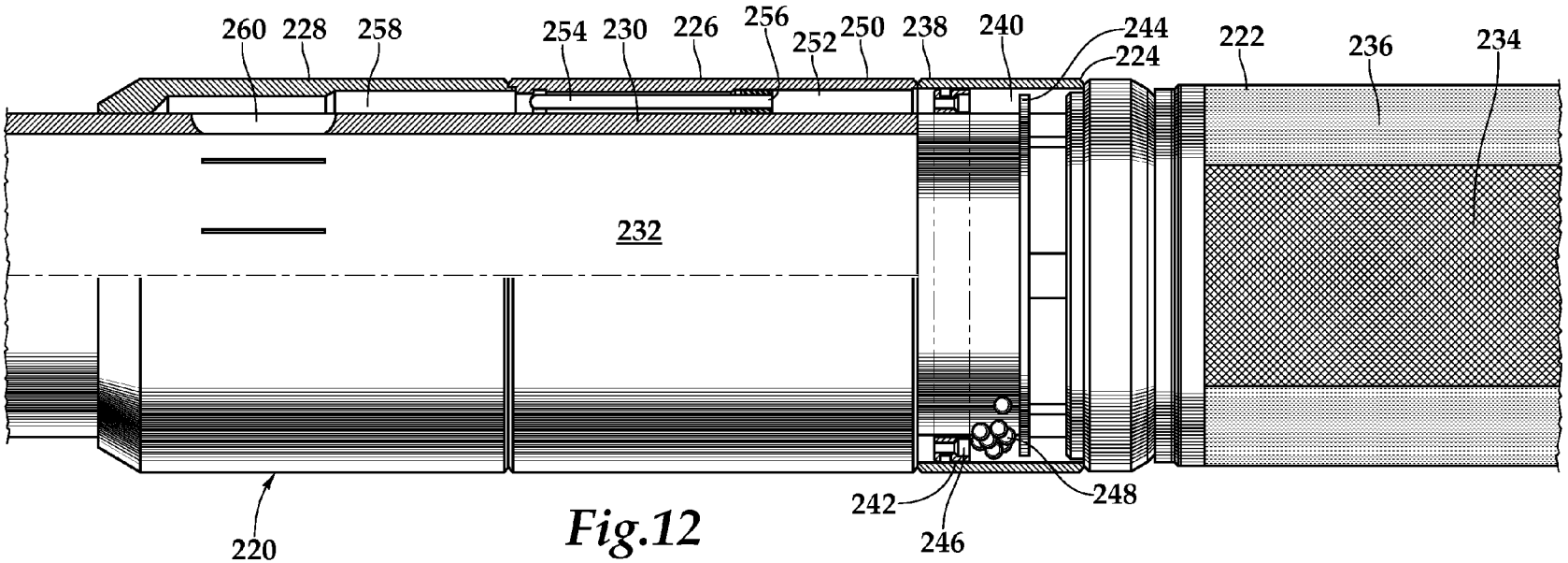
FIG. 12 is a side view of a sand control screen assembly according to an embodiment of the present invention.

Referring next to FIG. 12, therein is depicted a side elevation view partially in cross section of a sand control screen assembly in its running configuration that embodies principles of the present invention and is generally designated 220. Sand control screen assembly 220 includes a sand control screen section 222, a fluid discriminator section 224, a flow restrictor section 226 and a fluid inlet section 228. Sand control screen assembly 220 includes a base pipe 230 that defines an internal flow path 232. Sand control screen section 222 includes a filter medium 234 that is exposed around approximately a 120 degree nonperforated circumferential section of base pipe 230. Filter medium 234 includes outer and inner drainage layers that have a relative course wire mesh with a filtration layer disposed therebetween having a relatively fine mesh. Positioned around the remaining 240 degree circumferential section of base pipe 230 of sand control screen section 222 is a swellable material layer 236. Swellable material layer 236 is attached to base pipe 230 or filter medium 234 by bonding or other suitable technique.

Fluid discriminator section 224 is configured in series with sand control screen section 222 such that fluid must pass through sand control screen section 222 prior to entering fluid discriminator section 224. Fluid discriminator section 224 includes an outer housing 238 that defines an annular chamber 240 with a nonperforated section of base pipe 230. Fluid discriminator section 224 also includes retainer rings 242, 244. Retainer ring 242 has a plurality of outlets 246 circumferentially spaced therein designed to provide a fluid passageway from chamber 240 to flow restrictor section 226.

One or more flow blocking members 248, depicted as spherical members or balls are disposed within chamber 240 between retainer rings 242, 244 and cooperate with outlets 246 to restrict the flow of any undesired portion of the production fluids that enter fluid discriminator section 224. For example, in the case of a production fluid containing both oil and water, the density of members 248 is such that certain of the outlets 246 are blocked by certain of the members 248 to shut off or choke the flow of water therethrough. Thus, when the production fluid is mainly oil, members 248 will be positioned relatively distant from outlets 246, for example, at the bottom of chamber 240. When a sufficient proportion of water is present in the production fluid, however, members 248 will restrict flow of the water by shutting off or choking flow through certain ones of the outlets 246.

Flow restrictor section 226 is configured in series with fluid discriminator section 224 such that fluid must pass through fluid discriminator section 224 prior to entering flow restrictor section 226. Flow restrictor section 226 includes an outer housing 250 that is suitably coupled to outer housing 238 of fluid discriminator section 224. Outer housing 250 defines an annular chamber 252 with a nonperforated section of base pipe 230. Disposed within chamber 252 is an annular flow rate controller 254. Flow rate controller 254 includes one or more tubular passageways 256 that provide a relative long, narrow and tortuous pathway for the fluids to travel within flow restrictor section 226 and that provide a more restrictive pathway than the unrestricted pathway through fluid discriminator section 224. As such, flow restrictor section 226 is operable to restrict the flow rate of the production fluids through sand control screen assembly 220.

Once the production fluids pass through flow rate controller 254 of flow restrictor section 226, they enter annular chamber 258 and eventually enter the interior of base pipe 230 via openings 260 which are depicted in the form of slots. Once inside base pipe 230, the production fluids flow to the surface within the tubing string.

Fluid discriminator section 224 is operable in various flow regimes and with various configurations of flow blocking members 248. For example, members 248 may have a single density and be designed to block a single type of undesirable fluid such as water or gas in an oil production operation, or may have two densities and be designed to block multiple types of undesirable fluids such as water and gas in an oil production operation. Also, all of the members intended to block a certain undesired fluid do not necessarily have the same density. Instead, the members in each category could have a range of different densities so that the members are neutrally buoyant in different densities of production fluids.

Even though FIG. 12 has described a particular embodiment of a fluid discriminator section, other types of fluid discriminating mechanisms can be used in association with the sand control screen assemblies of the present invention, such as those described in U.S. Pat. No. 7,185,706, and United States Application Publication Numbers US 2008-0041580 A1, US 2008-0041581 A1, US 2008-0041588 A1, and US 2008-0041582 A1, each of which is hereby incorporated by reference for all purposes. Likewise, even though FIG. 12 has described a particular embodiment of a flow restrictor section, other types of flow restricting mechanisms can be used in association with the sand control screen assemblies of the present invention, such as those described in U.S. Pat. Nos. 5,803,179, 6,857,476, 6,886,634, 6,899,176, 7,055,598, 7,096,945, and 7,191,833, and United States Application Publication Numbers US 2006-0042795 A1, US 2007-0039741 A1, US 2007-0246407 A1, US 2007-0246210 A1, and, US 2007-0246213 A1, each of which is hereby incorporated by reference for all purposes.

Optionally, it may be desirable to prevent fluid loss into the formation during high pressure operations internal to sand control screen assembly 220. In such a case, a fluid loss control valve such as a one-way valve or a check valve (not pictured) may be installed between base pipe 230 and the outer housing and preferably within chamber 258. Likewise, in certain embodiments, it may be desirable to selectively allow and prevent flow through a sand control screen assembly of the present invention such as sand control screen assembly 220. In such embodiments, a valve or other flow control device may be placed in the fluid flow path between the exterior of sand control screen assembly 220 and internal flow path 232. For example, a sliding sleeve (not pictured) may be operably associated with base pipe 230 and openings 260. The sliding sleeve may be disposed internally of base pipe 230 within internal flow path 232 or may preferably be disposed externally of base pipe 230 within the annular region between the outer housing and base pipe 230. The sliding sleeve may have an open position wherein fluid flow through openings 260 is allowed and a closed position wherein fluid flow though openings 260 is prevented. In addition, the position of the sliding sleeve may be infinitely variable such that the sliding sleeve may provide a choking function. The sliding sleeve may be operated mechanically, electrically, hydraulically or by other suitable means.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly operably positionable within a wellbore, the sand control screen assembly comprising:

a base pipe having at least one opening in a sidewall portion thereof;

a filter medium disposed exteriorly of at least a first circumferential portion of the base pipe, the filter medium in fluid communication with the at least one opening; and a swellable material layer disposed exteriorly of a second circumferential portion of the base pipe, the swellable material layer being thicker proximate a midpoint of the second circumferential portion of the base pipe than proximate an endpoint of the second circumferential portion of the base pipe;

wherein, in response to contact with an activating fluid, radial expansion of the swellable material layer causes the filter medium to be displaced toward a surface of the wellbore.

2. The sand control screen assembly as recited in claim 1 wherein the filter medium circumferentially extends around the first and second circumferential portions of the base pipe.

3. The sand control screen assembly as recited in claim 1 wherein the filter medium circumferentially extends around only the first circumferential portion of the base pipe.

4. The sand control screen assembly as recited in claim 1 wherein the first circumferential portion is between about 10 degrees and about 180 degrees.

5. The sand control screen assembly as recited in claim 1 wherein the first circumferential portion is about 120 degrees.

6. The sand control screen assembly as recited in claim 1 wherein the filter medium further comprises at least one of a single layer mesh screen, a multiple layer mesh screen, a wire wrapped screen, a prepack screen, a ceramic screen, a fluid porous, particulate resistant sintered wire mesh screen and a fluid porous, particulate resistant diffusion bonded wire mesh screen.

7. The sand control screen assembly as recited in claim 1 wherein the swellable material layer is circumferentially segmented.

8. The sand control screen assembly as recited in claim 1 wherein the swellable material layer is longitudinally segmented.

9. The sand control screen assembly as recited in claim 1 wherein the swellable material layer provides fluid isolation to the filter medium.

10. The sand control screen assembly as recited in claim 1 wherein the swellable material layer provides fluid isolation to a plurality of sections of the filter medium.

11. The sand control screen assembly as recited in claim 1 wherein the swellable material layer is helically disposed exteriorly of the base pipe.

12. The sand control screen assembly as recited in claim 1 further comprising swellable material disposed between the base pipe and the filter medium.

13. The sand control screen assembly as recited in claim 1 wherein the activating fluid is at least one of a hydrocarbon fluid, water and gas.

14. The sand control screen assembly as recited in claim 1 wherein in response to contact with the activating fluid, radial expansion of the swellable material layer causes the filter medium to contact the wellbore.

15. The sand control screen assembly as recited in claim 1 wherein the swellable material layer is disposed exteriorly of the filter medium.

16. The sand control screen assembly as recited in claim 1 wherein the swellable material layer is disposed adjacent to the base pipe.

17. The sand control screen assembly as recited in claim 1 wherein the swellable material layer is disposed exteriorly of a nonperforated section of the base pipe.

18. The sand control screen assembly as recited in claim 1 wherein the swellable material layer is disposed exteriorly of a perforated section of the base pipe.

19. The sand control screen assembly as recited in claim 1 wherein the filter medium is disposed exteriorly of a nonperforated section of the base pipe.

20. The sand control screen assembly as recited in claim 1 wherein the filter medium is disposed exteriorly of a perforated section of the base pipe.

21. The sand control screen assembly as recited in claim 1 wherein the second circumferential portion of the base pipe is approximately 180 degrees.

22. A method of installing a sand control screen assembly in a wellbore, the method comprising:

running the sand control screen assembly to a target location within the wellbore, the sand control screen having a filter medium disposed exteriorly of at least a first circumferential portion of a base pipe;

contacting a swellable material layer disposed exteriorly of a second circumferential portion of the base pipe with an activating fluid, the swellable material layer being thicker proximate a midpoint of the second circumferential portion of the base pipe than proximate an endpoint of the second circumferential portion of the base pipe;

radially expanding the swellable material layer in response to contact with the activating fluid; and displacing the filter medium toward a surface of the wellbore in response to the radial expansion of the swellable material layer.

23. The method as recited in claim 22 wherein the step of radially expanding the swellable material layer in response to contact with the activating fluid further comprises contacting the swellable material layer with at least one of a hydrocarbon fluid, water and gas.

24. The method as recited in claim 22 wherein the step of displacing the filter medium toward a surface of the wellbore in response to the radial expansion of the swellable material layer further comprises placing the filter medium in contact with the wellbore in response to the radial expansion of the swellable material layer.

* * * * *